US009526365B2

(12) United States Patent
Sinmaz

(10) Patent No.: US 9,526,365 B2
(45) Date of Patent: Dec. 27, 2016

(54) LAUNDRY BASKET HANGER

(71) Applicant: Tulin Sinmaz, Castle Hill (AU)

(72) Inventor: Tulin Sinmaz, Castle Hill (AU)

( * ) Notice: Subject to any disclaimer, the term of this patent is extended or adjusted under 35 U.S.C. 154(b) by 13 days.

(21) Appl. No.: 14/279,356

(22) Filed: May 16, 2014

(65) Prior Publication Data

US 2016/0157650 A1 Jun. 9, 2016

(30) Foreign Application Priority Data

May 17, 2013 (AU) ..... 2013100680

(51) Int. Cl.
*A47G 25/20* (2006.01)
*D06F 95/00* (2006.01)

(52) U.S. Cl.
CPC ..... *A47G 25/20* (2013.01); *D06F 95/00* (2013.01); *D06F 95/002* (2013.01)

(58) Field of Classification Search
CPC ..... D06F 59/00–59/06; D06F 73/00; D06F 95/00; D06F 95/002; A47G 25/20; A47G 25/24; A47G 25/28; A47G 25/34; A47G 25/70; A41H 5/00; A47F 5/01; A47F 5/13; A47F 7/19; A47F 7/22; A47F 8/00; A45C 13/26; B65D 1/38
USPC ..... D32/37
See application file for complete search history.

(56) References Cited

U.S. PATENT DOCUMENTS 1,150,732 A 8/1917 Barnes
1,524,014 A * 1/1925 Boorstin ..... B42F 9/00 211/181.1
1,591,336 A * 7/1926 Printz ..... B65D 7/20 220/485
1,722,122 A * 7/1929 Wilson ..... A47C 7/64 211/106
2,084,854 A * 6/1937 McCarthy ..... D06F 59/02 108/119
2,219,145 A * 10/1940 Wolf ..... A47F 7/22 2/115

(Continued)

FOREIGN PATENT DOCUMENTS

AU 201300680 A4 * 8/2013
AU 2014100433 A4 * 6/2014

(Continued)

*Primary Examiner* — Ismael Izaguirre

(57) ABSTRACT

A detachable laundry basket hanger comprises a plurality of elongated loop parts, each elongated loop part descending and tapering inwardly to form a torso shaped structure with a raised center, each loop part configured to hang a garment, the raised center configured to accommodate collars of shirts and tops, the elongated loop parts having common expandable ends at each side of the elongated loop parts, the expandable ends configured to bear inward to clamp onto objects. Further description of the present invention relates to a method and a unique device and/or apparatus for displaying and/or storing garments and clothing and other apparel. In particular the present invention provides an organizational tool itself a multi-purpose, multi-membered, garment/clothes hanger comprises at least one substantially torso configuration hanger member, adapted as or an adjunct or add-on to a support structure in addition, a solution wrinkle and crease free for storage in transport.

6 Claims, 5 Drawing Sheets

(56) References Cited

U.S. PATENT DOCUMENTS

| | | | | | |
|---|---|---|---|---|---|
| 2,493,864 | A | * | 1/1950 | Forman | D06F 71/40 223/69 |
| 2,944,673 | A | | 7/1960 | Geluso | |
| 3,517,865 | A | * | 6/1970 | Juraschek | D06F 71/40 223/69 |
| 3,534,865 | A | | 10/1970 | Holliman | |
| 4,669,642 | A | * | 6/1987 | Nicholas | A47G 25/14 211/118 |
| 4,957,230 | A | * | 9/1990 | Gonzales | A47G 25/14 223/88 |

FOREIGN PATENT DOCUMENTS

| | | | | |
|---|---|---|---|---|
| GB | 415653 | A | | 8/1934 |
| GB | 2529171 | A | * | 2/2016 |

* cited by examiner

LAUNDRY BASKET HANGER

CROSS REFERENCE TO RELATED APPLICATION

This application claims the priority date benefit from Australian Innovation Patent application. No. 2013100680 filed on May 17, 2013.

BACKGROUND OF INVENTION

Field of Invention

The present invention relates to a multipurpose, detachable garment/clothes hanger adjunct, in the aspect embodiment of a multipurpose garment/clothes hanger provides a complete solution for storing, elevated hanging garments/clothing, as stated, on a singular member hanger or a plurality of member hangers.

The described elevation feature aspect embodiment of the present invention, comprise of first elevation aspect consequent of the common ends adapted as removable connecting component, as with the stated applications, a further elevating aspect of the described garment/clothes hanger by a second elevation embodiment of the described horizontal strut, to comprise a central raised section feature.

The specifications comprising of the elevation aspect embodiment and the adjunct applications, as described of the present invention, the specificities of the garment/clothes hanger adjunct to an object, receives the described hanger by applications of assemblage, to consequent the elevated formation for the disposed hanger, subsequent a hung or hanging form of a disposed garment; or hanging garment disposed on the adapted hanger members, effectively hoisting the disposed garments and clothing, for storing laundry upright, in and onto a laundry basket or laundry hamper for transporting. The described application is positive to eliminate wrinkles and creases sequent of the ensemble onto; or to; or of, object i.e., a laundry basket or laundry hamper, or ironing board/table or the seats of chairs. Creases, wrinkles, crumpling are a result of when articles of clothing have dried, additionally to gather or when 'bringing in the washing', subsequent of washed clothing, machine or hand washed or laundered otherwise. As a result, the drying and aerating process, requires adequate storing on completion, the drawbacks of heaping or folding or gathering or throwing laundry in collection, into a laundry basket or laundry hamper, cause the garment to dry ridged, further creases and wrinkles occur, drying garments and clothing on coat hangers need to be hand carried, the present inventions cancels the wrinkles, creases, and any additional coat, clothes hangers and the subsequent stands or holdings of the coat and clothes hangers.

SUMMARY OF THE INVENTION

The aspect embodiment of the described present invention is the application (to adjunct) to and for assemblage to the supporting structures of the topmost portions of a laundry basket or a laundry hamper, and is claimed by the title of a Laundry Basket Hanger (Adjunct).

The object embodiment of the outline formation of a substantially beam formed structure, together forming the specified configuration to correspond and correlate to the width and dimensions consistent to counter balance the assemblage (and adjunct) of the described objects, (when disposed for use).

The preferred embodiments of the described garment/clothes hanger configuration comprises the aspect embodiments of the common end portions; or common arm portions, thereof, the consequent common removable connecting component, adapted to receive the described objects for ensemble and assembling applications. The described design of a substantially torso configuration, of the present invention, is not limited to a single member hanger configuration, therefor the optional embodiment of the described configuration, comprises of a multiply; or a plurality members, per described hanger configuration.

A feature embodiment of the present invention is a singular or a multi-member; or a plurality of hanger members, as described additionally comprises the preferred embodiments of the attachment formation of the described common members of the removable/connecting device (common end portions), together combining is a whole configuration, a complete unit, a complete embodiment of all the described features; or a configuration of all the stated aspect embodiments combined, accurately give detailed description of the present invention. Therefor the above description effective mobilize wet or dried hanging garments or clothing or apparel, the object embodiments of the described device. Furthermore, the combined described embodiments, solve as a complete garment/clothes hanger configuration device; or a whole configuration of the described feature aspects inclusive of a complete hanger/hanging device; or a whole clothes/garment hanger apparatus. The applicability aspect of the light-weight embodiment, described, effectively subsequent the above statements, of the featured article of manufacture of the present invention. The described light weight aspect embodiment subsequences the apparatus to better hang garments/clothing, additionally, the light weight aspect embodiment substantiates the elevation novice of the described garment hanger, wherein the described configuration of a substantial torso counter balance to comprises common parallel ends members, adapted to stand, adapted for the common device members, to uphold or to hoists upon the ensemble or assembled objects.

Furthermore the preferred embodiment of the present invention comprises the specific configuration of a torso formation garment/clothes hanger, is an apparatus garment/clothes hanger, a device adapted, to and for the assemble to or an ensemble to, by method of applications, described, to consequent by; engages; affixes; clamp; fasten; embrace; or to fit to the described objects. The stated methods of affixtures, attachment, ensemble, assemble; the connecting formation for applications to adjunct the present invention, relate to the described common connecting/removing devices. The devices are adapted to receive the outer periphery; or the exterior; or the side proximities; or the outer surfaces of traditional and non-traditional laundry baskets, laundry hampers, Ironing boards/tables, pieces of furniture specifically seats of chairs, i.e. objects.

Wherein the specific application method of the present invention for fastening; or adjoining; or embracing; or fitting; or clamping; or affixing; or connecting; or attaching to and for assembling, and to ensemble, is consequential of the method for the disposal to an object, therefor to apply the application method to motion an exert force outwards of the common end members, adversely force of the per end members, (opposing). The adverse force of the common connecting components adapted to receive the features of an object in placement. The motioned positioning of the common end/arm members are position in propionate of the object to receive. The subsequent expansion of the common connecting components are adapted as the arm/end portions, for applications as described.

A further aspect of embodiment and a further description of the object of embodiment, comprises the integrally formation per specific members of the present invention's configuration, together combining, adapted to receive the outer periphery of and to, the connecting objects, wherein, the aspect embodiments of the removable aspect of the connecting component members, are the adapted devices and are the internally formations to positively receive the outer periphery for connecting adjunct.

BRIEF DESCRIPTION OF THE DRAWINGS

Further disclosure, objects, advantages and aspects of preferred and other embodiments of the present application may be better understood by those skilled in the relevant art by reference to the following description of embodiments taken in conjunction with the accompanying drawings, which are given by way of illustration only, and thus are not limitative of the disclosure herein, and in which.

DETAILED DESCRIPTION OF THE PREFERRED EMBODIMENTS

Figure 1:
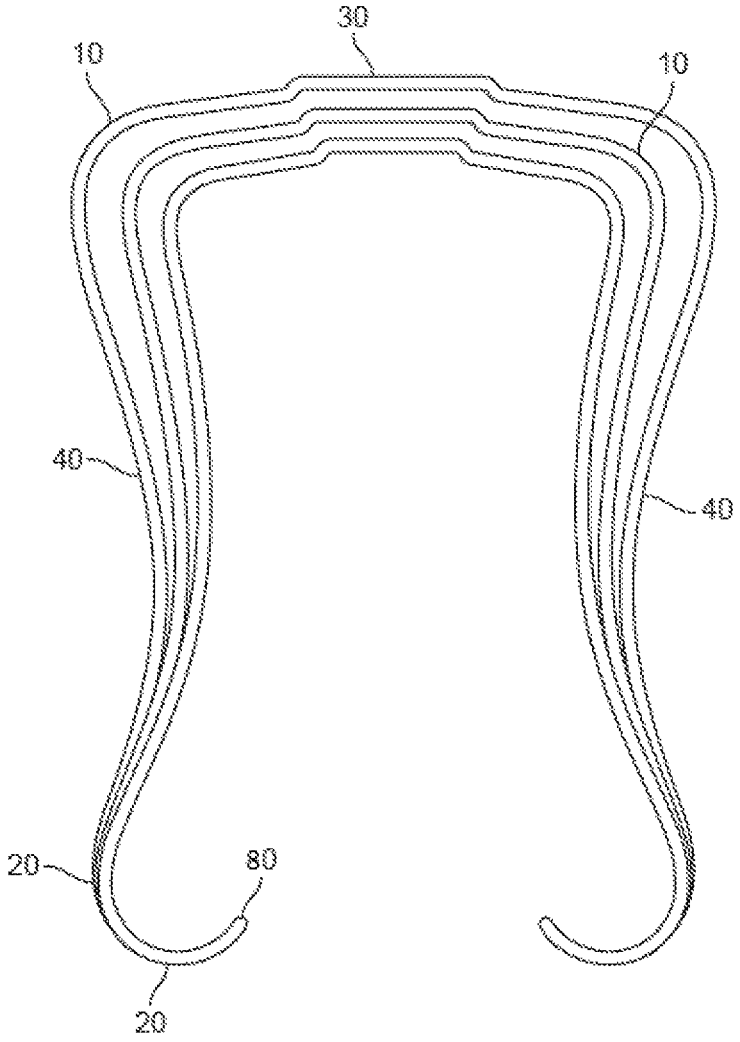
FIG. 1 illustrates a preferred embodiment of the present invention comprises common curved end configuration.

With reference to the drawings FIG. 1 represents the perspective view of laundry basket hanger 10 the convex member 20 curved end configuration adapted to receive a corresponding connecting portion 10 the convex member adapted to receive the shoulder aspect embodiment of a substantial torso configuration 20 curved end configuration comprises rubber lining embodiment 80 rubber lining and/or a variety of other flexible materials, adaptable to positive receive plastic, wooden or weaved laundry baskets or hampers. As shown in FIG. 1 per embodiment of the garment/clothes hanger embodies a member to adapted to for a portion of a substantial torso configuration 40 the elongated member adapted to receive the waist or midriff of the substantial torso configuration 10 convex members comprises the connecting formations of the descending and inward tapering parallel members and the horizontal strut comprises a central raised section 30. The aspect embodiment of the raised centre portion adapted to receive the neck band formations, a feature aspect of the substantially torso configuration 30 the aspect embodiment of a slight angular deviation adapted to receive and support portions of collars of shirts and tops 10 the aspect embodiment of a convex member proportionate and correspond to adapt to the accessorize to the periphery and/or the dimensions that of a standard laundry basket or laundry hamper and in adaption and corresponding to the substantial torso configuration 20 thus enabling the adjunct applications of the garment/clothes hanger.

Figure 2:
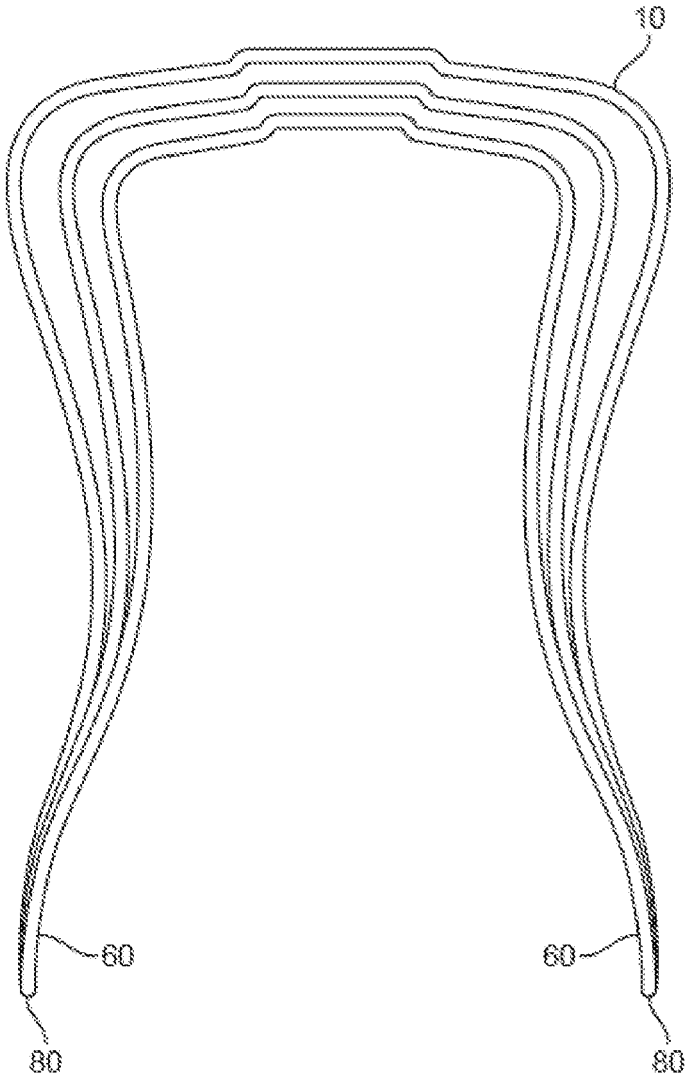
FIG. 2 illustrates a preferred embodiment of the present invention comprises common straightened end configuration.

FIG. 2 A preferred embodiment of the present invention comprises a multi-membered garment/clothes hanger member as claimed, and as shown in FIG. 1 the garment/clothes hanger with common straightened ends 60 an optional embodiment of a common curved end configuration comprises rubber lining embodiment 60 the straightened end configuration adapted to receive a corresponding connecting portion to adjunct to a rimless laundry basket, or the plane exteriors 80 the preferred embodiments comprises the internally formation of the branching disposed members to combine together forming the common connecting components adapted as the common end portions to receive the attachment connecting formation.

Figure 3:
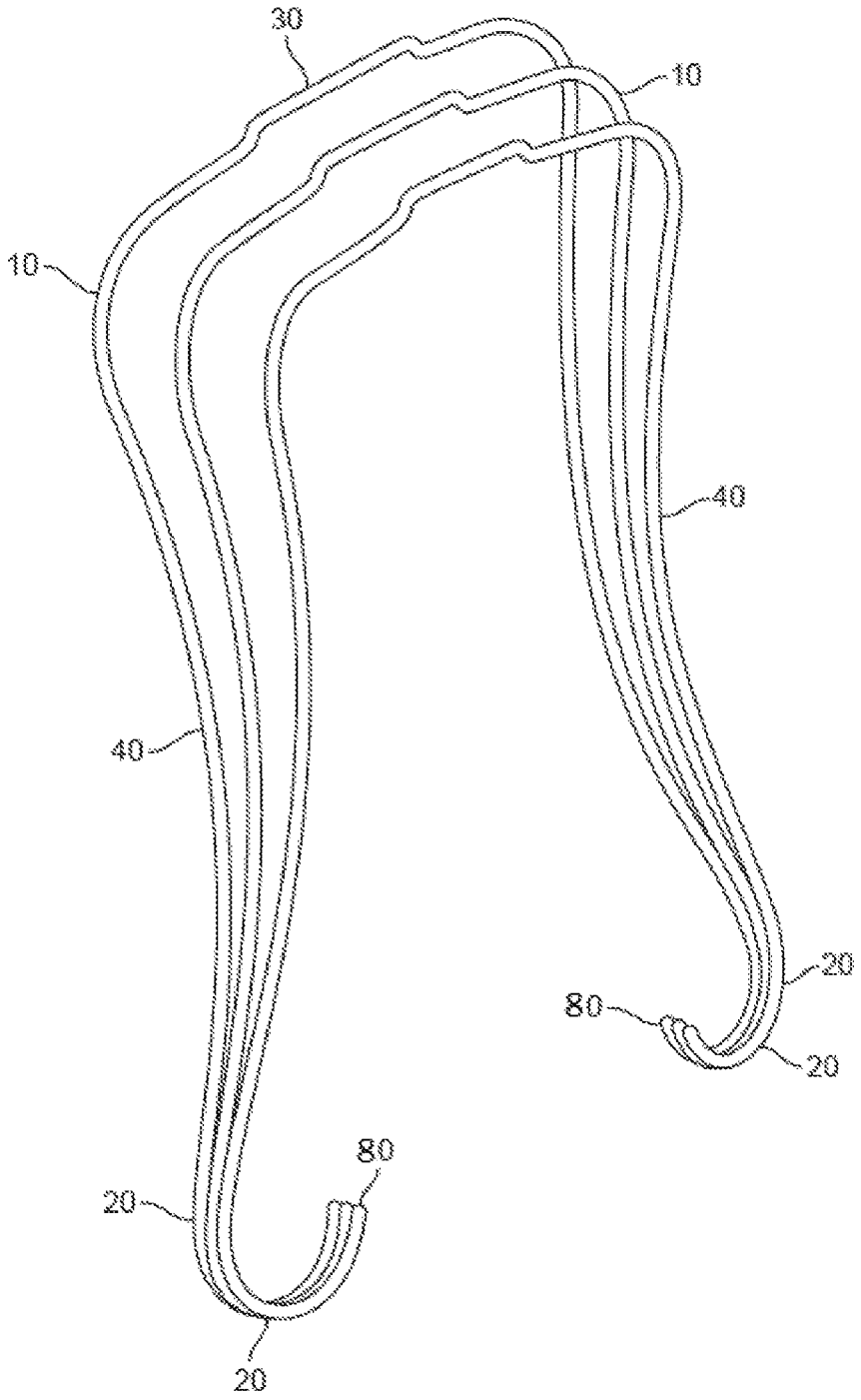
FIG. 3 shows the perspective view of Laundry basket hanger with common curved ends.

FIG. 3 represents the laundry basket hanger 10 attached at the common expandable ends 20 to a standard laundry basket 70 standard laundry baskets have an opening that is between 42 cm to 53 cm wide, averaging 48 cm wide, correspondents to the Laundry Basket Hanger 10 can accommodate most standard size laundry baskets/or hampers. Demonstrates the light-weight embodiment of the Laundry Basket Hanger 10 the applications of use for the garment/clothes hanger device as adjuncts to a conventional and non-conventional laundry baskets, without compromising the structure integrity of the objects.

Figure 4:
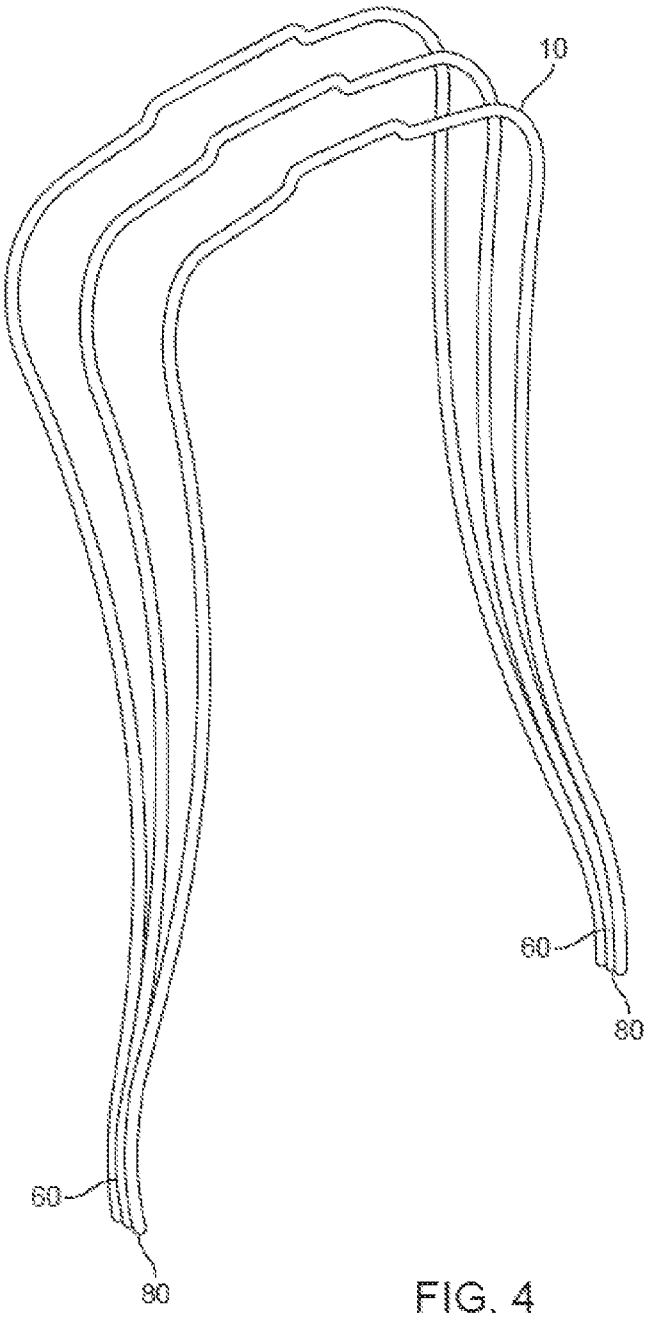
FIG. 4 shows the perspective view of laundry basket hanger with common straightened ends.

FIG. 4 A perspective view of the present invention comprises the common straight end configuration. 10 per formed members combine together forming, integral connection there between the first attachment formations of one end portion member along the configuration to the opposing end portion member 80 the machine formation of the common end connecting components 60 together formation of an end component comprises the integral formations of the beam members circuitry forming of the two opposing sides to combine together forming a symmetrical torso formation 60 and 80.

Figure 5:
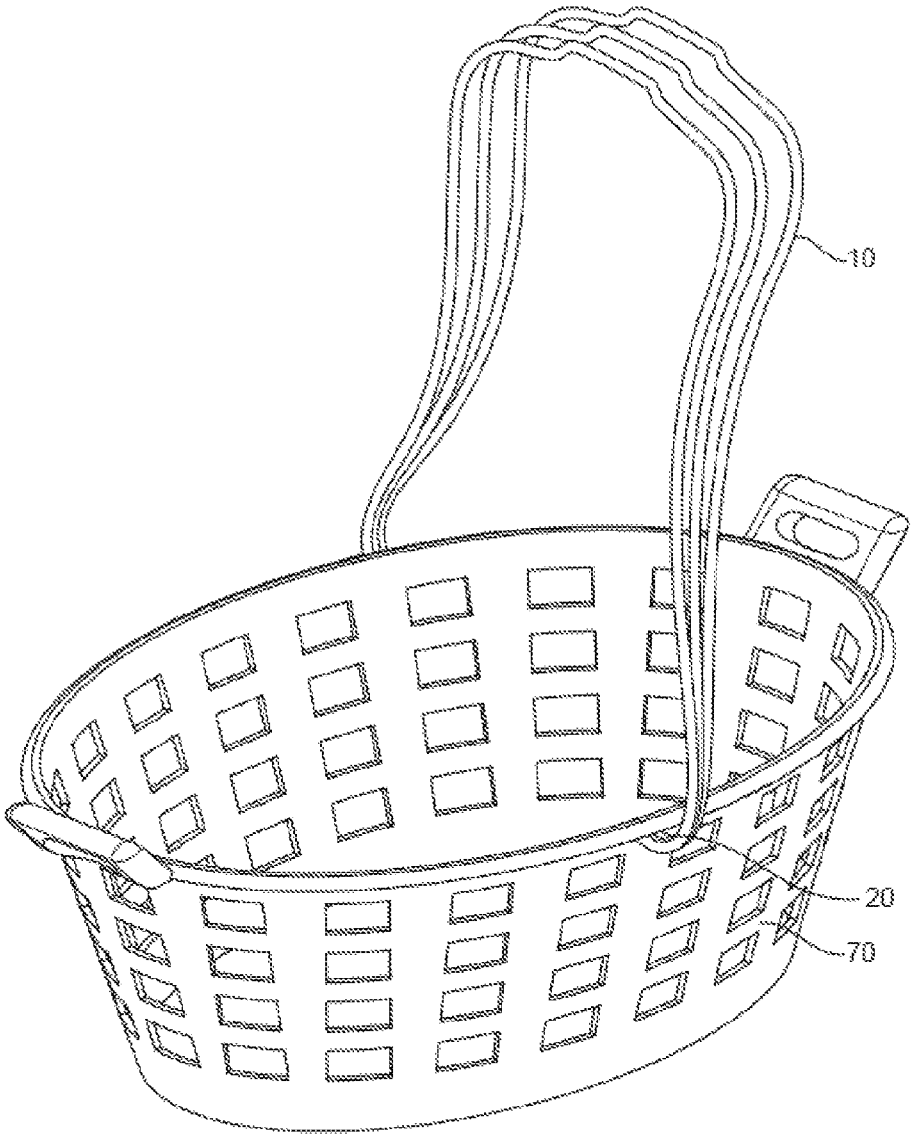
FIG. 5 shows the preferred embodiment of the present invention illustrating FIG. 1, in use Adjunct or an Add-On adapted in the connection formation to the respective support structure of a laundry basket, disposed, to the assemblage to a laundry basket.

FIG. 5 An organization tool for hanging and storing garments 10 an accessory to adjunct to the conventional and standard laundry baskets 20 an Adjunct or an Add on for an assemblage to 70 laundry baskets.

While the written description of the invention describes the invention in the best possible mode thereof, it is expected that the ordinary skilled in the art understands variations, modifications and combinations of the preferred embodiments. The invention shall not be construed as limiting by the mentioned embodiments, methods, examples, terminologies or phraseologies, but by all embodiments and methods within the scope and ambit of the invention claimed.

What is claimed is:

1. A detachable laundry basket hanger comprising:

a plurality of elongated loop parts, each elongated loop part descending and tapering inwardly to form a torso shaped structure with a raised centre, each loop part configured to hang a garment, the raised centre configured to accommodate collars of shirts and tops;

the elongated loop parts having common expandable ends at each side of the elongated loop parts, the expandable ends configured to bear inward to clamp onto objects.

2. A multipurpose, detachable laundry basket hanger as claimed in claim 1, wherein the elongated loop parts are formed from one or more of polyethylene, polypropylene, PVC, or steel.

3. A multipurpose, detachable laundry basket hanger as claimed in claim 1, wherein the common expandable ends are inwardly curved to clamp onto the rim or protruding lip of the laundry basket.

4. A multipurpose, detachable laundry basket hanger as claimed in claim 1, wherein the common expandable ends are straight and have an inward facing lining formed from a flexible material to provide a secured grip.

5. A multipurpose, detachable laundry basket hanger as claimed in claim 1 wherein the hanger can hang garments when detached from the laundry basket or hamper.

6. A multipurpose, detachable laundry basket hanger as claimed in claim 4 wherein the common expandable ends are straight and have an inward facing lining formed from a flexible material to provide a secured grip.

* * * * *